US007699627B2

(12) United States Patent
Xiang et al.

(10) Patent No.: US 7,699,627 B2
(45) Date of Patent: Apr. 20, 2010

(54) ELECTRICAL CONNECTOR WITH IMPROVED CONTACTS RETAINING MECHANISM

(75) Inventors: Xing-Hai Xiang, Kunshan (CN); Lun-Song Hu, Kunshan (CN); Zi-Qiang Zhu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/316,089

(22) Filed: Dec. 8, 2008

(65) Prior Publication Data

US 2009/0149072 A1 Jun. 11, 2009

(30) Foreign Application Priority Data

Dec. 6, 2007 (CN) ..... 2007 2 0131273 U

(51) Int. Cl.
*H01R 12/00* (2006.01)

(52) U.S. Cl. ..... 439/79; 439/541.5

(58) Field of Classification Search ..... 439/79, 439/80, 541.5
See application file for complete search history.

(56) References Cited

U.S. PATENT DOCUMENTS 5,643,008 A 7/1997 Tan et al.
5,800,207 A 9/1998 Hsu et al.
5,823,822 A * 10/1998 Tan et al. ..... 439/541.5
6,012,954 A 1/2000 Wu
6,027,370 A 2/2000 Hsu et al.
6,077,114 A * 6/2000 Lu ..... 439/541.5
6,095,853 A * 8/2000 Huang et al. ..... 439/541.5
6,626,700 B2 * 9/2003 Lin ..... 439/541.5
7,618,285 B2 * 11/2009 Xiang et al. ..... 439/541.5
2005/0026473 A1 * 2/2005 Shiu ..... 439/79
2009/0035964 A1 * 2/2009 Yamamoto et al. ..... 439/79

* cited by examiner

*Primary Examiner*—Renee S Luebke
*Assistant Examiner*—Larisa Tsukerman
(74) *Attorney, Agent, or Firm*—Wei Te Chung; Andrew C. Cheng; Ming Chieh Chang

(57) ABSTRACT

An electrical connector includes an insulative housing having a front mating face, a base portion, a mating portion protruding forwardly from the base portion and a number of passageways recessed rearward from the front mating face, the housing defining a number of blocks on a rear side thereof, the blocks each having an abutting face on a lower end thereof; a number of first contacts received in the passageways respectively and each including a contacting portion exposed in the passageway to mate with a corresponding mating connector, a level retaining arm fixed in the passageway and defining a front end connecting with the contacting portion and a rear end opposite to the front end, and a vertical mounting portion extending downwardly from a rear end of the retaining arm, the vertical mounting portion including a soldering portion to be soldered onto a printed circuit board and a protrusion tab extending laterally to have a larger width than that of the soldering portion, the protrusion tab abutting against the abutting face to prevent the vertical mounting portion from moving upwardly.

10 Claims, 7 Drawing Sheets

ELECTRICAL CONNECTOR WITH IMPROVED CONTACTS RETAINING MECHANISM

BACKGROUND OF THE INVENTION

1. Field of the Invention

The present invention relates to electrical connectors, more particularly to stacked electrical connectors.

2. Description of Related Art

In information technology, D-Sub connectors are widely adopted in computers and the like, in order to reduce the space which various kinds of electrical connectors occupy, connectors could be arranged in a stacked manner, for example, a plurality of audio jack connectors may be configured on a lower level, while a D-sub connector is located above the audio jack connectors, in this way, the D-sub connector and the audio jack connectors commonly defines a connector assembly and make the most of the inner space of the computer to be more compact.

Since the D-sub connector is arranged on a higher level, contacts of the D-sub connector is definitely configured to have a large length. The long contacts each includes a vertical retaining portion of a large length to be mounted onto to a printed circuit board, upon assembling the long contacts to the printed circuit board, the vertical retaining portion tends to move upwardly and deflect, thereby making it difficult to attach the long contact to the printed circuit board. Moreover, the predetermined shape of the long contact is destroyed.

BRIEF SUMMARY OF THE INVENTION

According one aspect of the present invention, an electrical connector to be mounted on a printed circuit board, comprising: an insulative housing having a front mating face, a base portion, a mating portion protruding forwardly from the base portion and a plurality of passageways recessed rearward from the front mating face, the housing defining a plurality of blocks on a rear side thereof, the blocks each having an abutting face on a lower end thereof; a plurality of first contacts received in the passageways respectively and each including a contacting portion exposed in the passageway to mate with a corresponding mating connector, a level retaining arm fixed in the passageway and defining a front end connecting with the contacting portion and a rear end opposite to the front end, and a vertical mounting portion extending downwardly from a rear end of the retaining arm, the vertical mounting portion including a soldering portion to be soldered onto the printed circuit board and a protrusion tab extending laterally to have a larger width than that of the soldering portion, the protrusion tab abutting against the abutting face to prevent the vertical mounting portion from moving upwardly upon assembling the electrical connector onto the printed circuit board.

According to another aspect of the present invention, a stacked electrical connector to be mounted a printed circuit board, comprising: a bracket defining a pair of upright arms, a supporting plate connecting with the upright arms, the supporting plate defining a plurality of blocks on a rear side thereof, the blocks each having an abutting face on a lower end thereof; a first connector straddling on the supporting plate and being sandwiched between the upright arms, comprising: a first insulative housing having a front mating face, a base portion, a mating portion protruding forwardly from the base portion and a plurality of passageways recessed rearward from the front mating face; a plurality of first contacts received in the passageways respectively and each including a contacting portion exposed in the passageway to mate with a corresponding mating connector, a retaining arm fixed in the passageway and defining a front end connecting with the contacting portion and a rear end opposite to the front end, and a vertical mounting portion extending downwardly from a rear end of the retaining arm, the vertical mounting portion including a soldering portion to be soldered onto the printed circuit board and a protrusion tab extending laterally to have a larger width than that of the soldering portion; the blocks being spaced from each other to define a slot between every two adjacent block, the first contacts each defining a fixing portion retained in the corresponding slot; the first insulative housing defining a spacer with a plurality of through holes extending therethrough, the soldering portions being retained in the through holes respectively and extending downwardly beyond the spacer; the spacer being retained on a lower side of the bracket, the protrusion tab being sandwiched between the abutting face and the spacer; and a second connector being located under the first connector and sandwiched between the upright arms, comprising a second insulative housing and a plurality of second contacts retained on the insulative housing.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
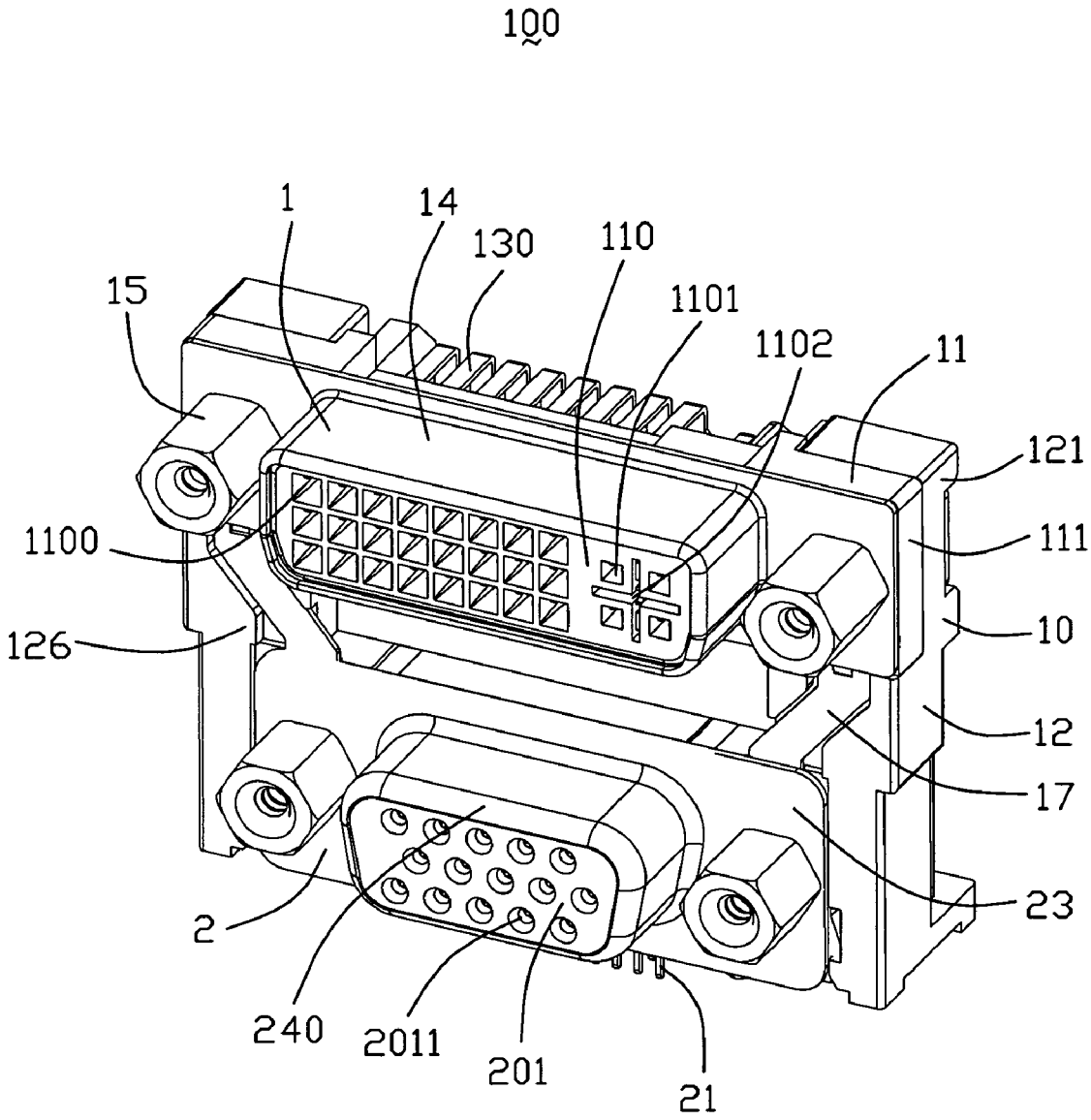
FIG. 1 is a perspective view of an electrical connector according to the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
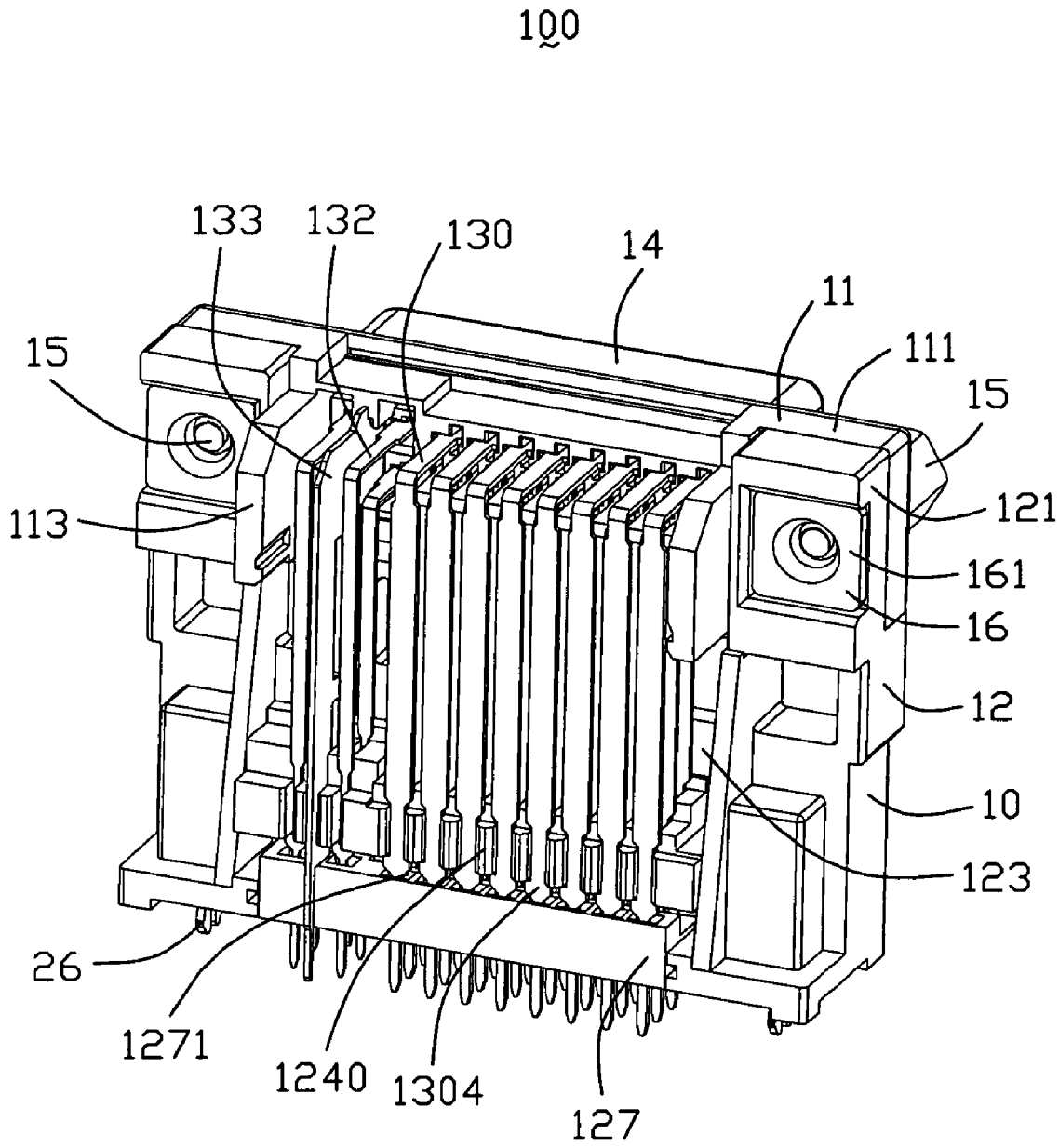
FIG. 2 is another perspective view of the electrical connector, while viewed from another aspect.
Figure 3:
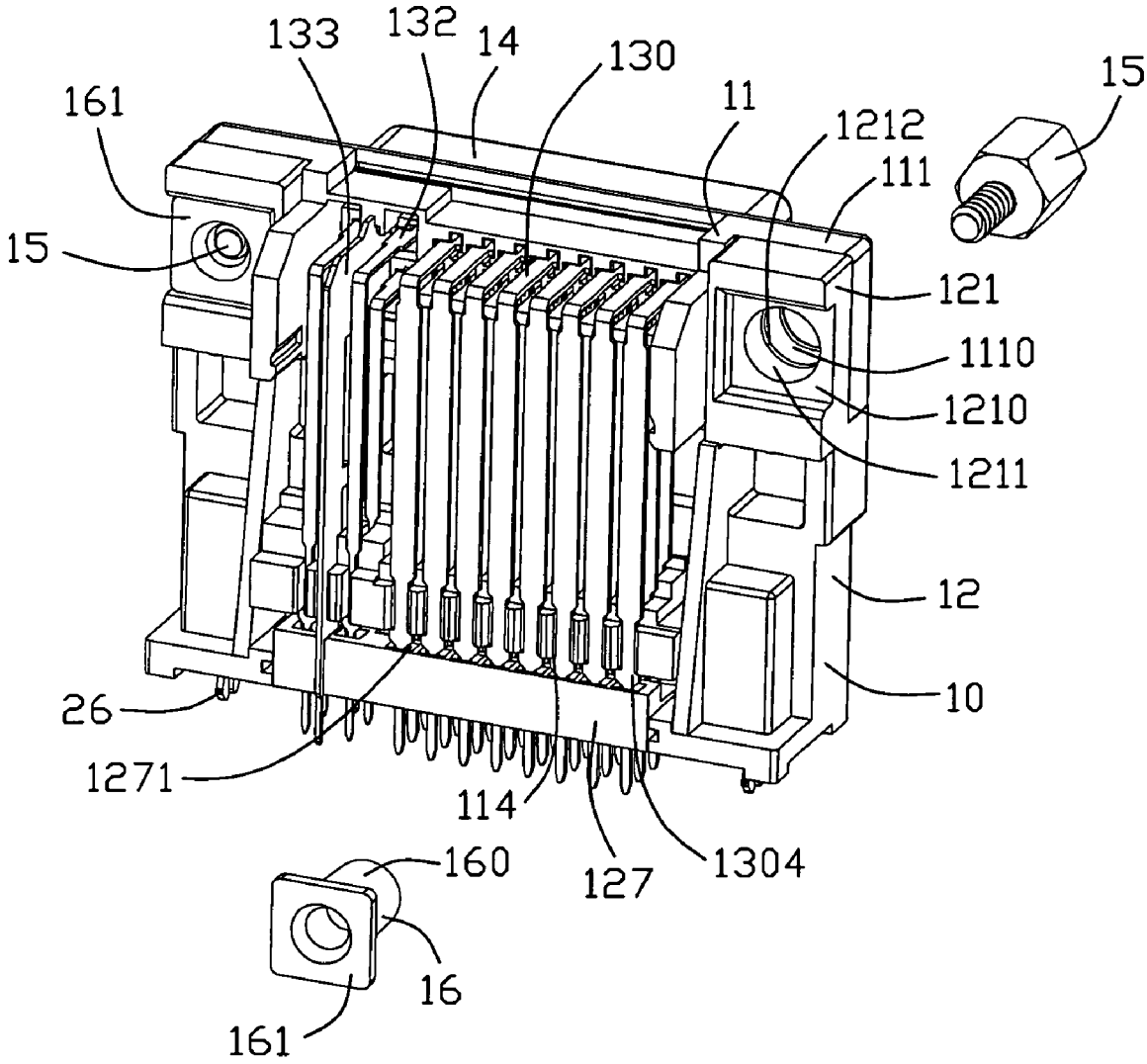
FIG. 3 is a partly exploded view of the electrical connector.
Figure 4:
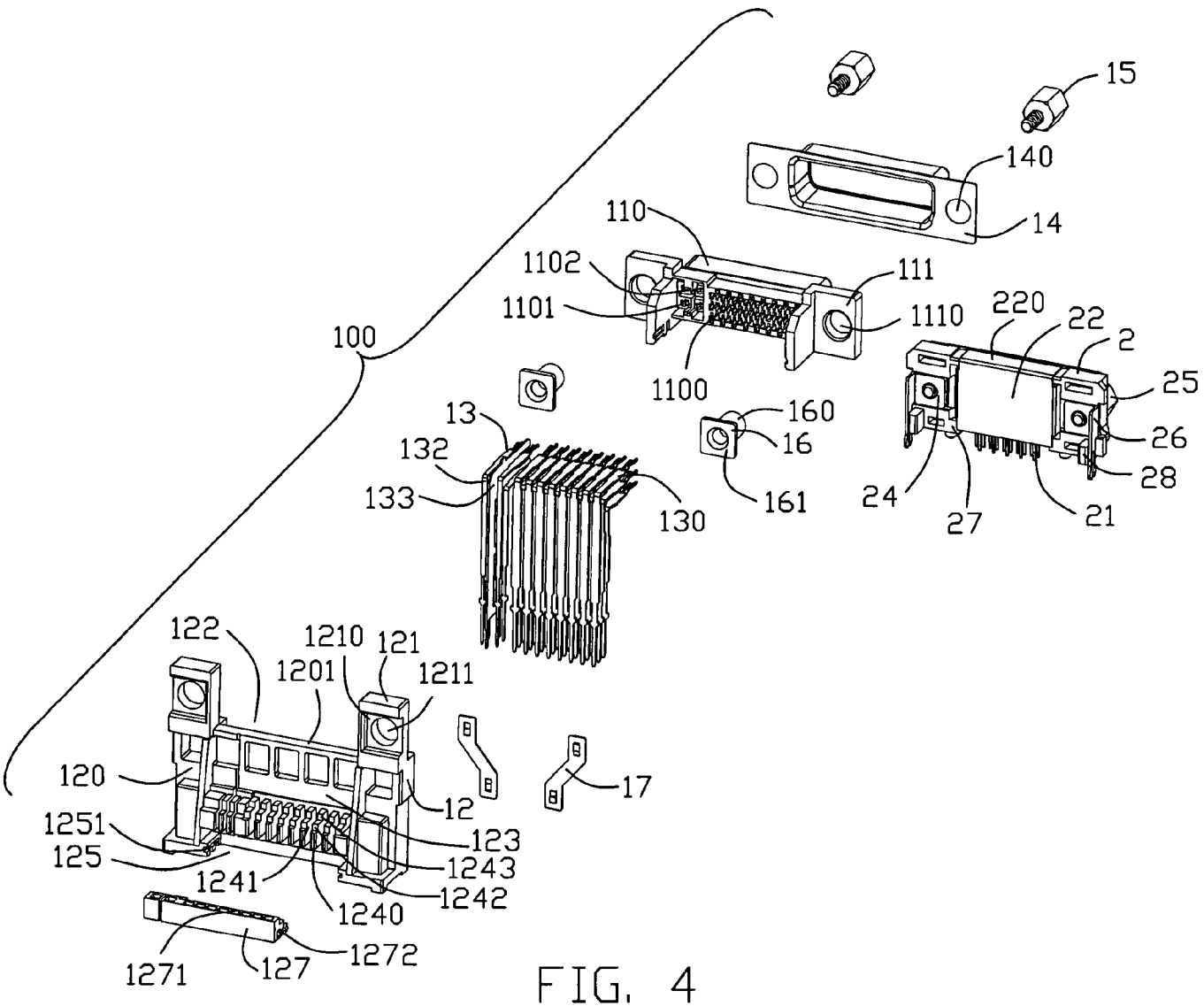
FIG. 4 is an exploded view of the electrical connector.
Figure 5:
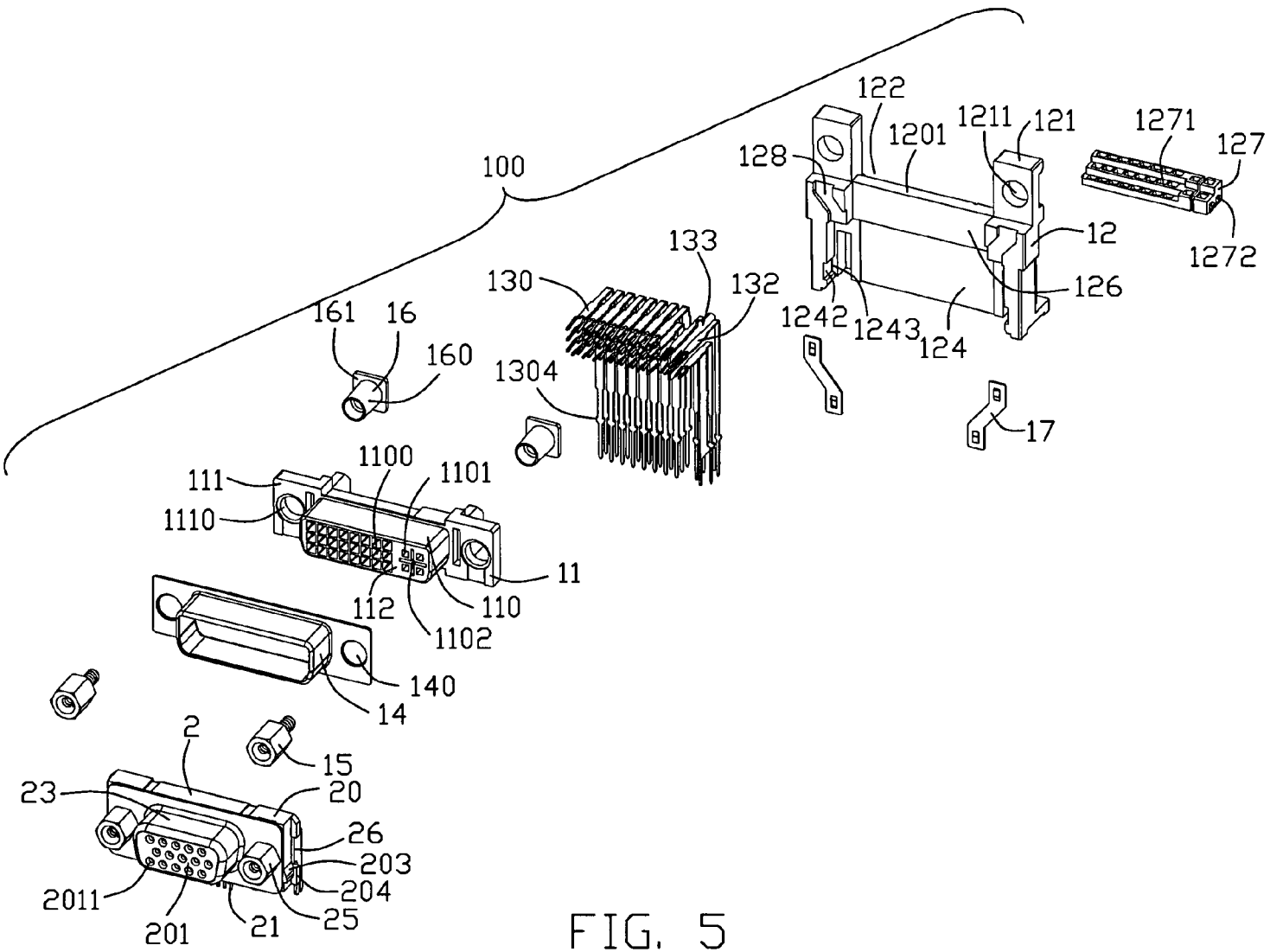
FIG. 5 is a view similar to FIG. 4, while taken from a different aspect.
Figure 6:
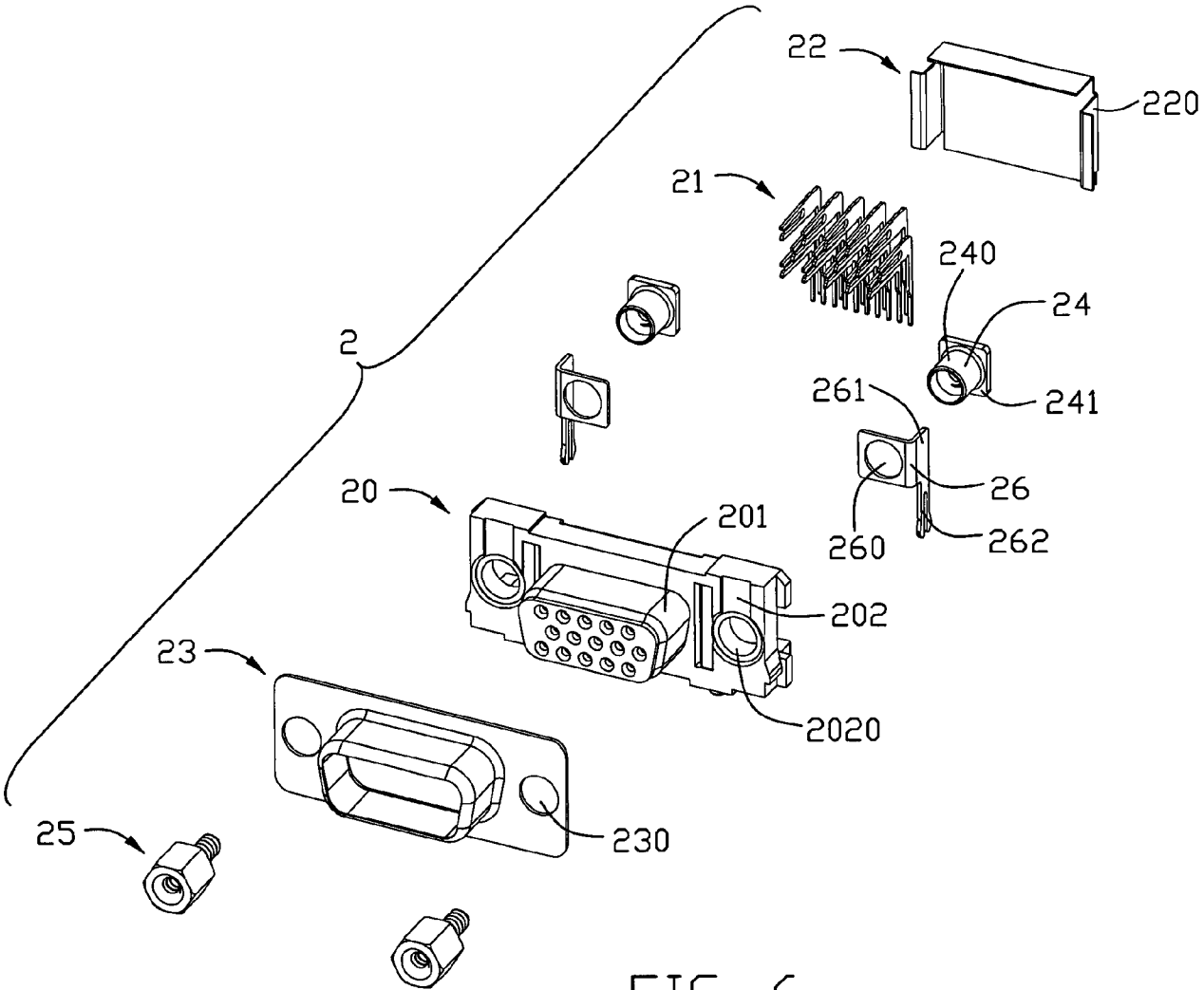
FIG. 6 is an exploded view of a second connector of the electrical connector.
Figure 7:
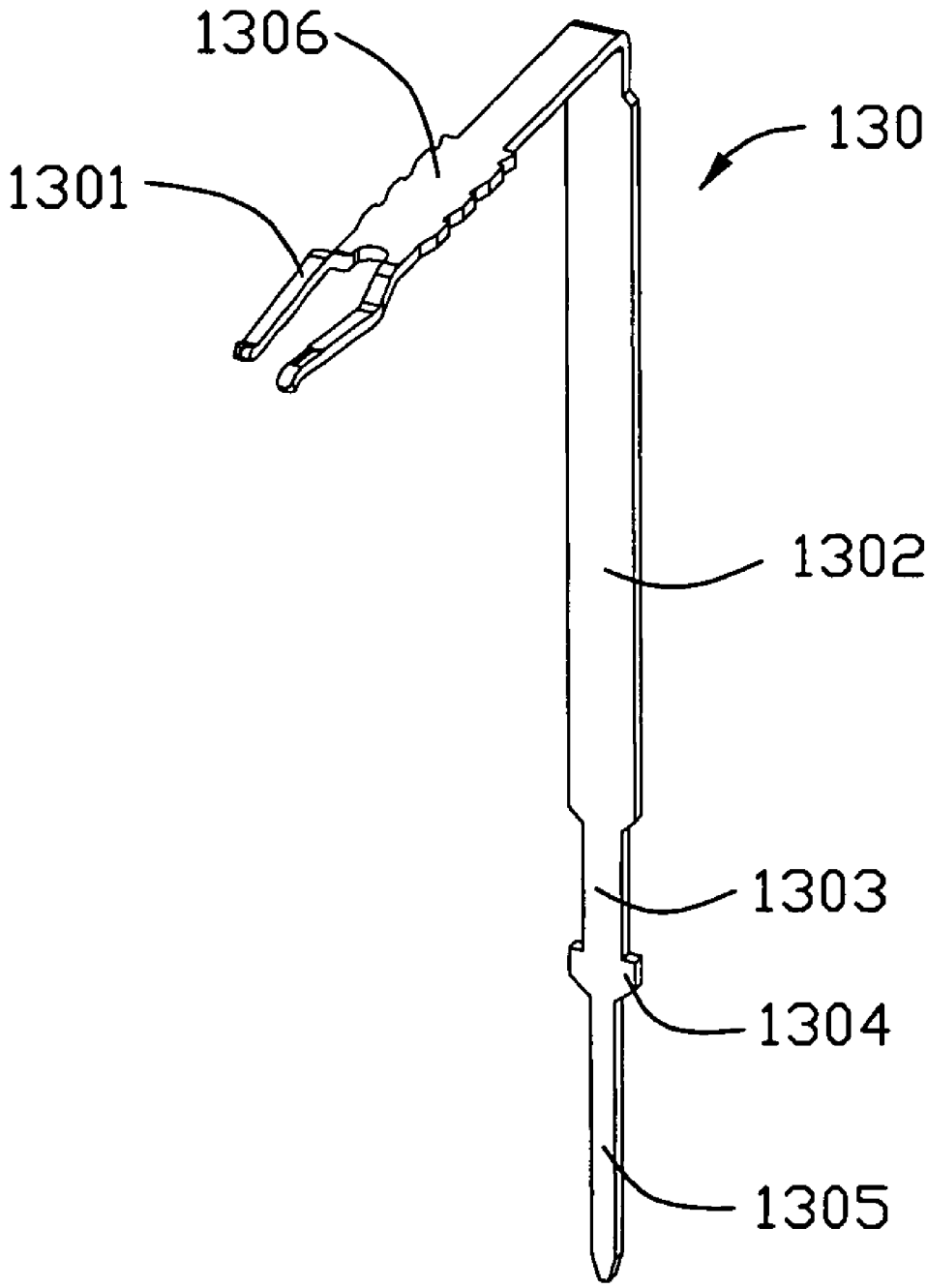
FIG. 7 is a perspective view of a first contact of the electrical connector.

Referring to FIGS. 1-6, an electrical connector 100 is preferably a stacked electrical connector 100 to be mounted onto a printed circuit board. The stacked electrical connector 100 comprises an insulative bracket 12 defining a pair of upright arms 121, a supporting plate 1201 connecting with the upright arms 121. A first receiving space 122 is formed between an upper portion of the upright arms 121 and an upper face of the supporting plate 1201, a second receiving space 124 is formed between a lower portion of the upright arms 121 and a lower portion of the supporting plate 1201. A first connector 1 straddles on the supporting plate 1201 and is sandwiched between upper portions of the upright arms 121. A second connector 2 is located under the first connector 1 and sandwiched between lower portions of the upright arms 121.

The first connector 1 preferably is a DVI connector and comprises a first insulative housing 11 having a front mating face 112, a base portion 111, a mating portion 110 protruding forwardly from the base portion 111 and a plurality of passageways 1100, 1101, 1102 recessed rearward from the front mating face 112. The supporting plate 1201 defines a plurality of blocks 1240 on a rear side thereof, the blocks 1240 each has an abutting face 114 on a lower end thereof. Alternatively, the blocks 1240 could be formed on a rear and lower side of the first insulative housing 11.

A plurality of first contacts 130 are received in the passageways 1100, 1101, 1102 respectively. The first contacts 130 each includes a contacting portion 1301 exposed in the passageway 1100 to mate with a corresponding mating connector, a level retaining arm 1306 fixed in the passageways 1100 and defining a front end connecting with the contacting portion 1301 and a rear end opposite to the front end, and a vertical mounting portion extending downwardly from the rear end of the retaining arm 1306. The vertical mounting portion includes a soldering portion 1305 to be soldered onto the printed circuit board and a protrusion tab 1304 extending laterally to have a larger width than that of the soldering portion 1305.

The first contacts 130 each defines a fixing portion 1303 connecting with the protrusion tab 1304, a body portion 1302 interconnecting with the fixing portion 1303 and the rear end of the retaining arm 1306. The fixing portion 1303 has a width smaller than that of the protrusion tab 1304. The body portion 1302 has a width larger than that of the fixing portion 1303. The blocks 1240 each defines a first step portion 1242 extending upwardly from an upper end thereof, a low end of the body portion 1302 abuts against a rear side face of the first step portion 1242. The blocks 1240 each further defines a second step portion 1243 located forward and above the first step portion 1242, the body portions 1302 are arranged in a first row abutting against the rear side face of the first step portions 1242 and a second row abutting against a rear side face of the second step portions 1343, the second row is located forward the first row. The body portions 1302 of the first row is longer than the body portions 1302 of the second row, the first step portion 1242 preventing the body portions 1302 of the first row from moving forward to contact with the body portion 1302 of the second row.

The blocks 1240 are spaced from each other to define a slot 1241 between every two adjacent blocks 1240, the fixing portions 1303 are retained in the corresponding slots 1241. The first housing 11 defines a spacer 127 with a plurality of through holes 1271 extending therethrough, the soldering portions 1305 are retained in the through holes 1271 respectively and extending downwardly beyond the spacer 127. The spacer 127 is retained on a lower side of the bracket 12 or the first housing 11, the protrusion tab 1304 is sandwiched between the abutting face 114 and the spacer 127. The protrusion tabs 1304 abut against the abutting face 114 to prevent the soldering portions 1305 from moving upwardly upon assembling the electrical connector 100 onto the printed circuit board.

The second connector 2 is preferably a D-sub connector and comprises a second insulative housing 20, a plurality of second contacts 21 retained on the insulative housing 20, a second front shell 23 and a second rear shell 22 commonly to enclose the second housing 20 and the second contacts 21, a board lock 26 attached to the second housing 20 to mount the second connector 2 to the printed circuit board. The first contacts 130 and the second contacts 21 are located on opposite side of the supporting plate 1201. The second front shell 23, the second housing 20, and the board lock 26 each is provided with a through hole 230, 2020, 260 respectively. A nut 25 extends through the through holes 230, 2020, 260 and interference engages with the screw 24 to lock the second front shell 23, the second housing 20, the board lock 26 together. The board lock 26 is formed with a soldering leg 262 to be mounted onto the printed circuit board. Alternatively, the soldering leg 262 may extend integrally from the second front shell 23.

The electrical connector 100 is further provided with a pair of grounding clips 17, the upright arms 121 each defines a recess 128 adjacent to the supporting plate 1201 to retain the grounding clips 17 respectively. The first connector 1 includes a first shell 14 surrounding the first contacts 130 and the first housing 11, the grounding clips 17 each connects with the first shell 14 and the second front shell 23 to make the first shell 14 electrically connected to the printed circuit board. The upright arms 121 each defines a cutout 1242 on an inner and lower side thereof, the second housing 20 is provided with a locking tab 203 on opposite sides thereof to lock with the cutout 1242. Rear side wall of the second rear shell 22 abuts against the supporting plate 1201.

The first insulative housing 11 defines a pair of ear portions 113 spaced from each other, the first contacts 130 are located between the ear portions 113. The first shell 14 is formed with a retention hole 140. The first connector 1 includes a screw 16, and a first nut 15 projecting through the retention hole 140 to lock the first shell 14, the first housing 11 and the screw 16 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical connector to be mounted on a printed circuit board, comprising:

an insulative housing having a front mating face, a base portion, a mating portion protruding forwardly from the base portion and a plurality of passageways recessed rearward from the front mating face, the housing defining a plurality of blocks on a rear side thereof, the blocks each having an abutting face on a lower end thereof;

a plurality of first contacts received in the passageways respectively and each including a contacting portion exposed in the passageway to mate with a corresponding mating connector, a level retaining arm fixed in the passageway and defining a front end connecting with the contacting portion and a rear end opposite to the front end, and a vertical mounting portion extending downwardly from a rear end of the retaining arm, the vertical mounting portion including a soldering portion to be soldered onto the printed circuit board and a protrusion tab extending laterally to have a larger width than that of the soldering portion, the protrusion tab abutting against the abutting face to prevent the vertical mounting portion from moving upwardly upon assembling the electrical connector onto the printed circuit board; wherein the blocks are spaced from each other to define a slot between every two adjacent blocks, the first contacts each define a fixing portion retained in the corresponding slot, the fixing portion connects with the protrusion tab, the fixing portion has a width smaller than that of the protrusion tab;

wherein the first contacts each define a body portion interconnecting with the fixing portion and the rear end of the retaining arm, the block defines a first step portion extending upwardly from an upper end thereof, the body portion abuts against a rear side face of the first step portion, the body portion has a width larger than that of the fixing portion; and wherein the block further defines a second step portion located forward and above the first step portion, the body portions include a first row abutting against the rear side face of the first step portion and a second row abutting against a rear side face of the second step portion, the second row is located forward the first row.

2. The electrical connector as claimed in claim 1, wherein the body portions of the first row are longer than the body portions of the second row, the first step portion preventing the body portions of the first row from moving forward to contact with the body portions of the second row.

3. The electrical connector as claimed in claim 1, wherein the insulative housing defines a spacer with a plurality of through holes extending therethrough, the soldering portions are retained in the through holes respectively and extending downwardly beyond the spacer.

4. The electrical connector as claimed in claim 3, wherein the spacer is retained on a lower side of the insulative housing, the protrusion tab is sandwiched between the abutting face and the spacer.

5. The electrical connector as claimed in claim 1, further comprising a bracket defining a pair of upright arms and a supporting plate connecting with the upright arms, the base portion straddles on the supporting plate and being sandwiched between the upright arms.

6. A stacked electrical connector to be mounted a printed circuit board, comprising:

a bracket defining a pair of upright arms, a supporting plate connecting with the upright arms, the supporting plate defining a plurality of blocks on a rear side thereof, the blocks each having an abutting face on a lower end thereof;

a first connector straddling on the supporting plate and being sandwiched between the upright arms, comprising: a first insulative housing having a front mating face, a base portion, a mating portion protruding forwardly from the base portion and a plurality of passageways recessed rearward from the front mating face; a plurality of first contacts received in the passageways respectively and each including a contacting portion exposed in the passageway to mate with a corresponding mating connector, a retaining arm fixed in the passageway and defining a front end connecting with the contacting portion and a rear end opposite to the front end, and a vertical mounting portion extending downwardly from a rear end of the retaining arm, the vertical mounting portion including a soldering portion to be soldered onto the printed circuit board and a protrusion tab extending laterally to have a larger width than that of the soldering portion;

the blocks being spaced from each other to define a slot between every two adjacent block, the first contacts each defining a fixing portion retained in the corresponding slot; the first insulative housing defining a spacer with a plurality of through holes extending therethrough, the soldering portions being retained in the through holes respectively and extending downwardly beyond the spacer; the spacer being retained on a lower side of the bracket, the protrusion tab being sandwiched between the abutting face and the spacer; and a second connector being located under the first connector and sandwiched between the upright arms, comprising a second insulative housing and a plurality of second contacts retained on the insulative housing; the first contacts each define a body portion interconnecting with the fixing portion and the rear end of the retaining arm, the block defines a first step portion extending upwardly from an upper end thereof, the body portions abut against a rear side face of the first step portion;

wherein the block further defines a second step portion located forward and above the first step portion, the body portions are arranged in a first row abutting against the rear side face of the first step portion and a second row abutting against a rear side face of the second step portion, the second row is located forward the first row, and the body portion of the first row is longer than the body portion of the second row, the first step portion preventing the body portion of the first row from moving forward to contact with the body portion of the second row.

7. The stacked electrical connector as claimed in claim 6, further comprising a pair of grounding clips, the upright arms each defines a recess adjacent to the supporting plate to retain the grounding clips respectively, the first connector includes a first shell surrounding the first insulative housing, the second connector includes a second shell surrounding the second contacts, the second shell defines a soldering leg to be mounted onto the printed circuit board, the grounding clips each connects with the first shell and the second shell.

8. The stacked electrical connector as claimed in claim 6, the protrusion tab abutting against the abutting face to prevent the soldering portions from moving upwardly upon assembling the electrical connector onto the printed circuit board.

9. The stacked electrical connector as claimed in claim 6, wherein the first contacts and the second contacts are located on opposite side of the supporting plate.

10. The stacked electrical connector as claimed in claim 6, wherein the body portion of the first row is longer than the body portion of the second row, the first step portion preventing the body portion of the first row from moving forward to contact with the body portion of the second row.

* * * * *